US006059633A

United States Patent [19]

Currier

[11] Patent Number: 6,059,633

[45] Date of Patent: May 9, 2000

[54] FRONT-OPENING GARMENT WITH BUILT-IN FRONT-OPENING BRA

[76] Inventor: Diane Currier, 103 Bradford Pl. SE., Poplar Grove, Ill. 61065

[21] Appl. No.: 09/250,475

[22] Filed: Feb. 13, 1999

[51] Int. Cl.[7] ..... A41C 3/08

[52] U.S. Cl. ..... 450/31; 450/7; 450/8; 450/9; 450/10; 450/11

[58] Field of Search ..... 450/31, 1, 8, 7, 450/9, 10, 11, 14–17, 28, 26, 30, 33; 2/105, 106, 114, 69, 78.1, 74, 109, 110

[56] References Cited

U.S. PATENT DOCUMENTS

| | | | |
|---|---|---|---|
| 639,440 | 12/1899 | Rutenberg | 2/78.1 |
| 709,200 | 9/1902 | Buckley | 2/78.1 |
| 1,164,642 | 12/1915 | Guinzburg | 2/109 |
| 1,254,043 | 1/1918 | James | 450/31 |
| 3,316,915 | 5/1967 | Howell . | |
| 3,348,241 | 10/1967 | Dodds . | |
| 4,372,320 | 2/1983 | Silber . | |
| 4,412,542 | 11/1983 | Reichert . | |
| 4,440,174 | 4/1984 | Cordova . | |
| 4,564,015 | 1/1986 | Friedman . | |
| 4,625,338 | 12/1986 | Starling | 2/106 |
| 4,797,954 | 1/1989 | Williams et al. | 2/106 |
| 5,211,598 | 5/1993 | Hall . | |
| 5,267,352 | 12/1993 | Rodarmel | 2/108 |
| 5,946,726 | 9/1999 | Green | 2/109 |

*Primary Examiner*—Gloria M. Hale
*Attorney, Agent, or Firm*—Keith Frantz

[57] ABSTRACT

A women's upper-body garment is provided with a front-opening outer garment and a front-opening inner bra having shoulder straps attached to the inside shoulders of the outer garment, and having breast supporting portions with elastic perimeter portions and formed to support the underside of the breasts.

10 Claims, 4 Drawing Sheets

FRONT-OPENING GARMENT WITH BUILT-IN FRONT-OPENING BRA

BACKGROUND OF THE INVENTION

1. Field of Invention

The present invention relates generally to women's apparel, and more specifically, to front-opening upper-body garments with built-in, non-binding breast support which, while suitable for other uses, is especially suitable for use with causal, leisure and nighttime apparel.

2. Description of Prior Art

Many women, and particularly larger breasted women, often prefer to have some breast support when wearing casual, leisure and nighttime apparel. At present, the choices for those desiring such support include wearing either a conventional bra, or a casual "pull-over" top that includes some form of shelf-type bra. Examples of such pull-over tops are shown in Friedman, U.S. Pat. No. 4,564,015, Cordova, U.S. Pat. No. 4,440,174, and Silber, U.S. Pat. No. 4,372,320. While such pull-over tops are suitable for certain women on certain occasions, they are not suitable for all occasions or for all women, and they are not typically worn under other types of casual/leisure apparel. Therefore, although conventional bras are often not desirable with leisure wear as they tend to be restrictive and binding against the breasts as a result of the supporting/forming hardware, or preformed and/or elastic nature of the breast cups, given the choices presently available, if wearing, for example, a leisure or nighttime robe, or a sweat-suit or similar top as casual wear, women desiring breast support will typically opt for wearing a conventional bra. This is particularly true when wearing front-opening garments, although they would often prefer a less restrictive alternative.

Thus, there is need for new and improved non-binding, less restrictive breast support apparel suitable for use with casual, leisure and nighttime front opening garments.

SUMMARY OF THE INVENTION

The general aim of the present invention is to provide new and improved front-opening garments suitable for casual, leisure and nighttime wear, and that include comfortable, generally non-binding and non-restrictive, breast support.

A detailed objective is to achieve the foregoing by providing a front-opening outer garment with a built-in front-opening bra attached at the shoulders for ease of putting the entire garment on and taking it off, and to permit freedom of movement of the outer garment relative to the bra.

Another detailed objective is to achieve the foregoing by providing the built-in bra with breast-supporting body portions adapted to drape over each breast, and with elastic perimeter portions adapted to draw the body portions upwardly into engagement with the lower portion of each breast to effect support from under the breast in a generally non-restrictive and non-binding manner.

These and other objectives and advantages of the invention will become more apparent from the following detailed description when taken in conjunction with the accompanying drawings.

Figure 1:
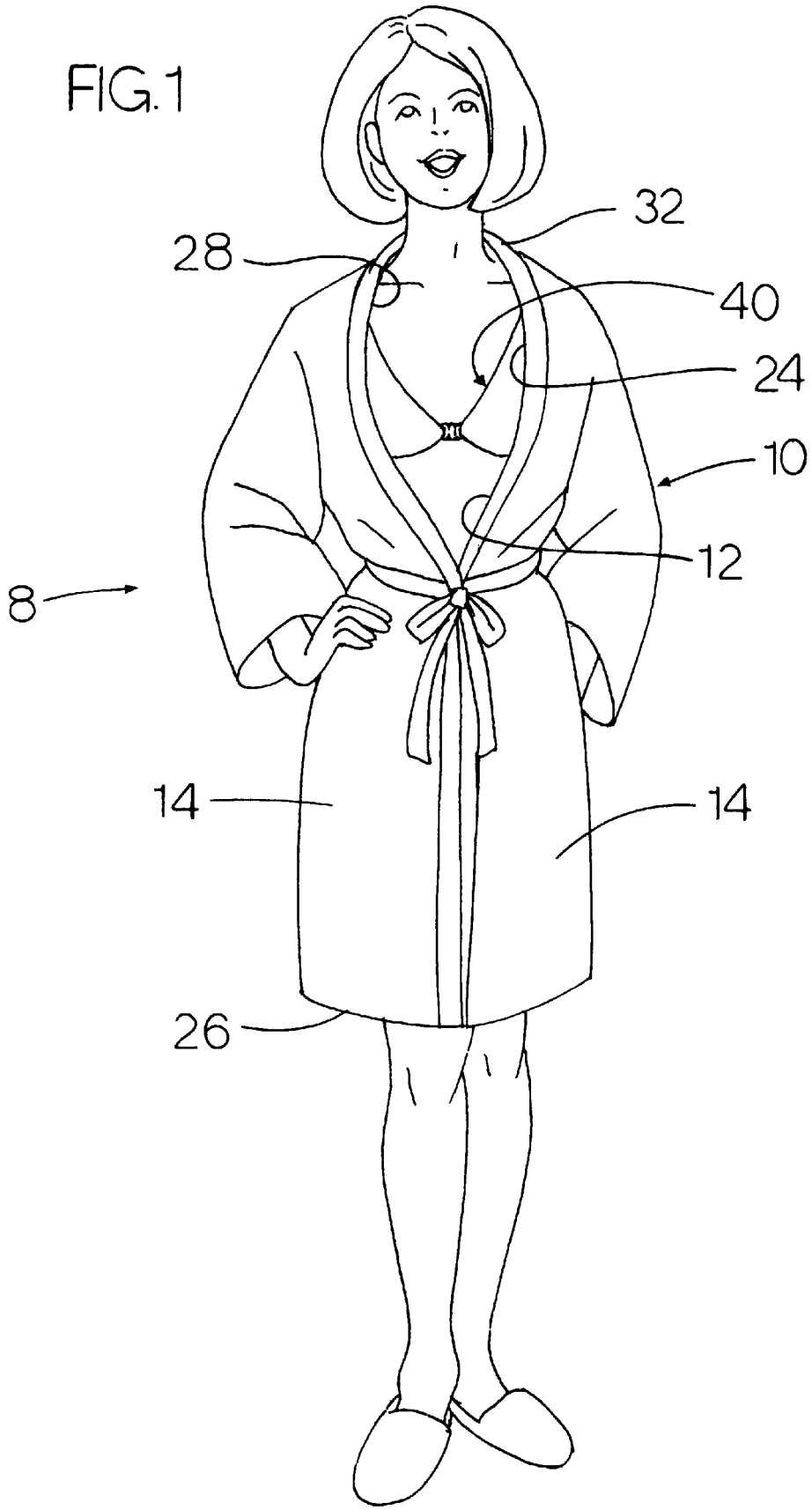
FIG. 1 is a front view of a new and improved garment comprising a robe and a built in bra, shown as worn by a user, and incorporating the unique aspects of the present invention.

While the invention is susceptible of various modifications and alternative constructions, certain illustrated embodiments have been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the invention.

DETAILED DESCRIPTION OF THE INVENTION

For purposes of illustration, the present invention is shown in the drawings in connection with a women's upper-body garment 8 including an outer garment in the form of a lounging robe 10 (FIG. 1) such as might be constructed in typical style and design associated with women's apparel. In a conventional manner, the robe 10 is formed with a front opening 12, wraps around the upper body of the wearer or user, and may by closed with a tie-belt around the user's waist. In this instance, the robe includes left and right (from the user's perspective) front sections 14, left and right sides, and a closed back, and extends between an upper neckline 24 to a lower hemline 26. The neckline 24 includes a front neckline section 28 that extends in opposite directions from the front opening 12 generally to the shoulders of the robe, and a back neckline section 32 that extends between the shoulders such that the neckline generally encircles the user's neck.

In accordance with the present invention, the garment 8 includes an integral or built-in bra 40 adapted for front opening, and to provide breast support under each breast, but which is free of supporting/binding/restrictive form or hardware of conventional bras. As a result, the robe 10 provides for a leisure or casual garment that is quick and easy to put on, and which provides the user with some breast support without being restrictive or binding.

Figure 2:
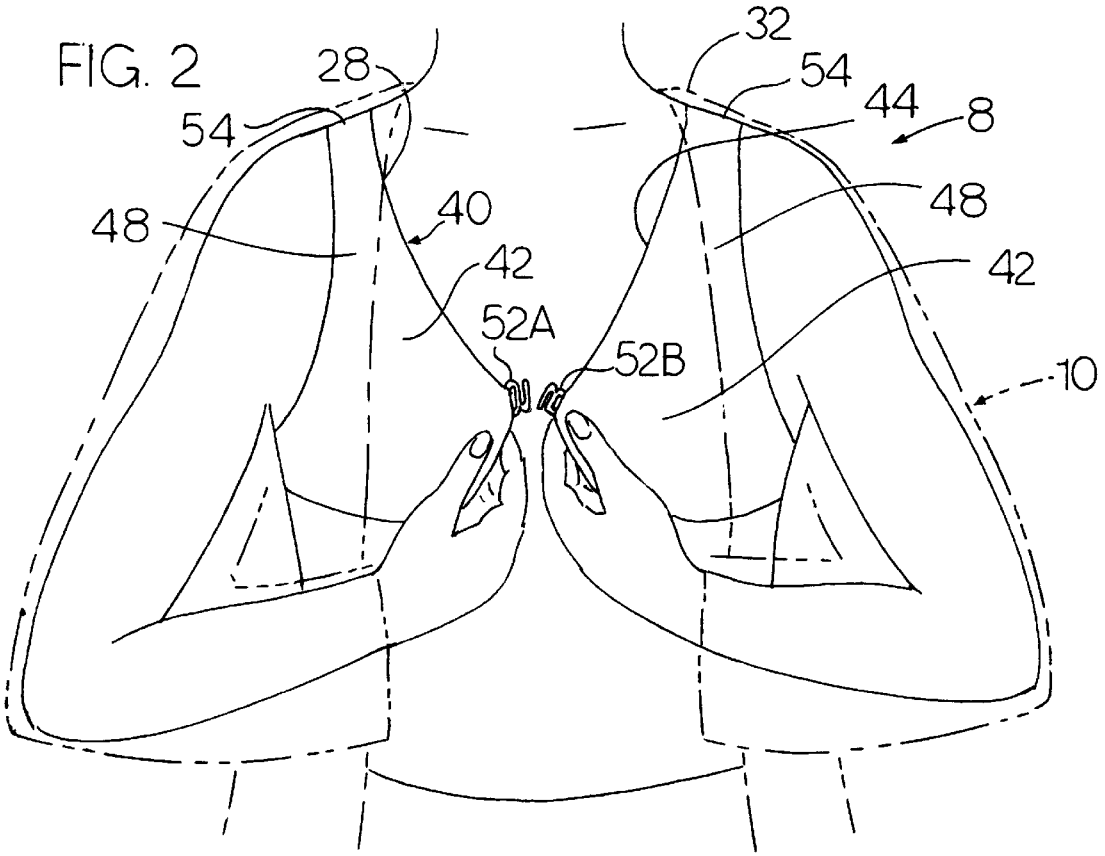
FIG. 2 is an enlarged front view, but showing the robe in dashed lines, and the built-in bra just prior to closure when putting the garment on, or alternately, just after opening for removal of the garment.
Figure 3:
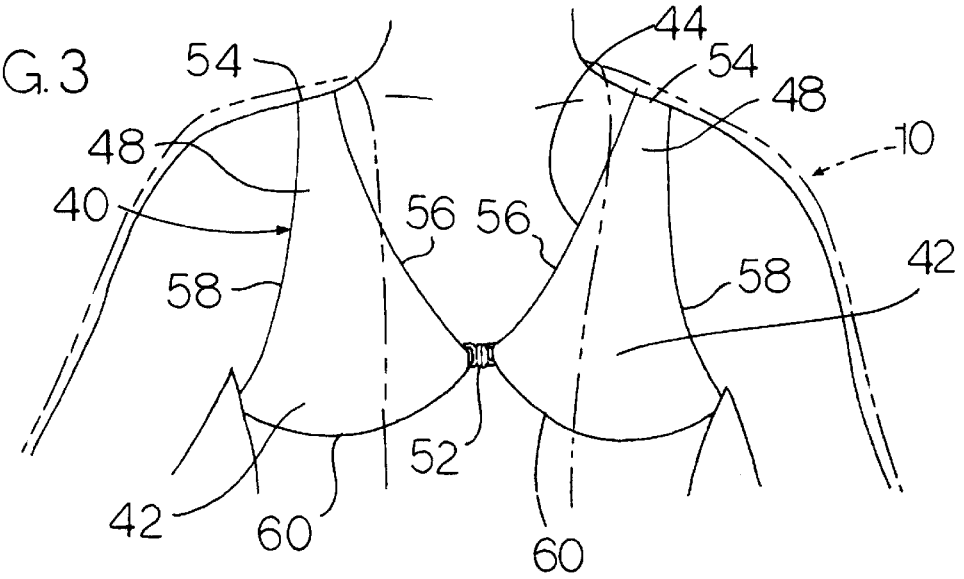
FIG. 3 is an enlarged front view similar to FIG. 2, but showing built-in bra in the closed position.
Figure 4:
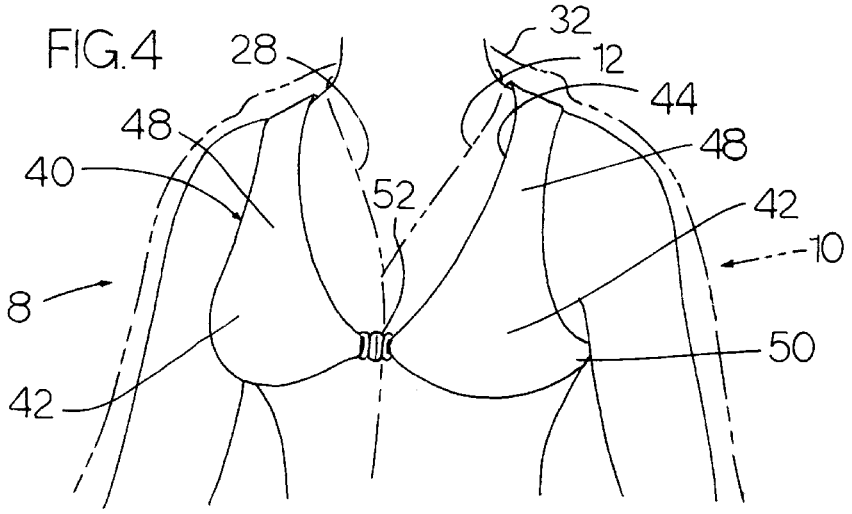
FIG. 4 is a view similar to FIG. 3, but showing the robe in position to conceal the built-in bra.
Figure 5:
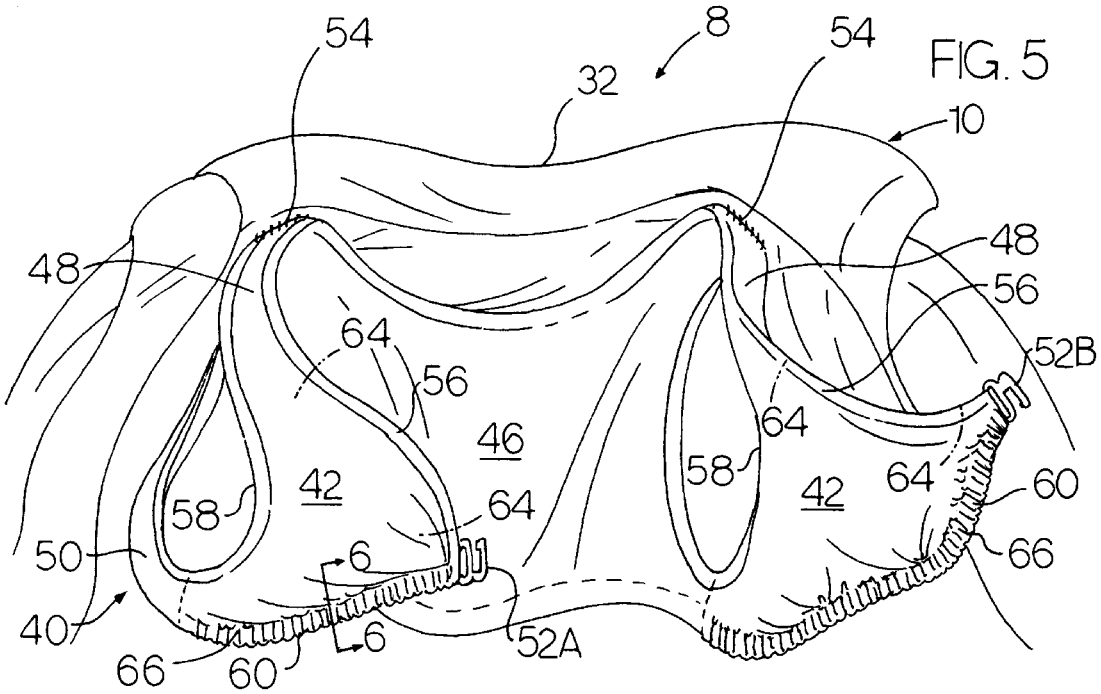
FIG. 5 is a front perspective view with the sides of the garment generally rolled back for improved viewing of certain aspects of the invention.
Figure 6:
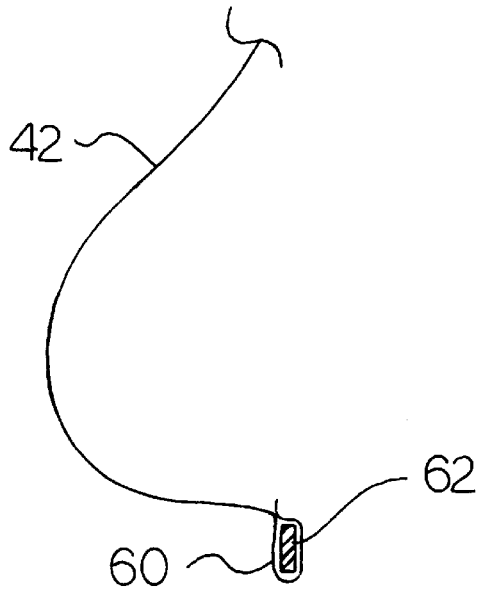
FIG. 6 is an enlarged cross-sectional view taken substantially along the line 6—6 of FIG. 5.

In carrying out the invention, the bra 40 includes left and right breast support front panels 42 (FIG. 2) separated by a front opening 44, a back panel 46 (FIG. 5), shoulder straps 48 extending between the upper portions of the front panels and the back panel to wrap over the user's shoulders, and side panels or straps 50 extending between the lower rear portions of the front panels and the back panel to wrap around the user's sides and under her arms. Front closure of the bra is accomplished in any suitable manner, such as with a plastic bra clasp 52 that slides or snaps (not shown) together, the two halves of the clasp 52A, 52B being connected to the forward lower corner portions of the front panels. In this instance, when the bra is closed, the front panels cooperate to define a generally V-shaped opening at the user's chest between her breasts. Preferably, the garment fabric, and in particular, the front panel and bra fabric is selected for comfort when worn next to the skin, such a cotton/lycra or other, preferably "stretchy", fabric blend.

In further carrying out the invention, the shoulder straps are attached (i.e., sewn) to the inside shoulders of the robe as generally designated at 54, with the armholes of the bra aligned with the armholes of the robe, and the front opening of the bra aligned with the front opening of the robe. Preferably, the only attachment between the bra and the robe is at the shoulders such that the robe is free to move relative to the bra, and thus, relative to the user's breasts. This permits substantially unrestricted freedom of movement of the outer garment robe as the user sits, stands, lies down, and generally moves around, without resulting in a corresponding pulling of the inner bra or associated pulling on the user's breasts.

In the preferred embodiment, the front panels are formed with a generally triangular shape, having inner and outer side edge portions, 56 and 58, respectively, for positioning to the sides of each breast, and lower edge portions 60 for positioning under the breasts. The body of the front panels are formed from relatively loose fitting material that drapes or freely hangs from the side edge portions of the panels. The lower edge portion of the front panels, and optionally the inner side edge portions, are formed with elastic perimeter portions. In the embodiment shown, elastic cord 62 is sewn into and concealed in the lower edge portion of the front panels, and optionally in the inner side edge portion, with the associated edge material preferably loosely surrounding the cord to define gathered-material lower front panel edge portions 66, and optional gathered-material inner side edge portions generally between dashed lines 64. With this arrangement, as the front panels are drawn toward one another and over the user's breasts for closure of the bra, the gathered lower edge portions stretch under and generally conform to the underside of each breast. As a result of the draping body construction of the front panels, the breasts generally rest on the lower portion of the front panels adjacent the lower edge portions for non-binding support when the bra is closed.

Figure 7:
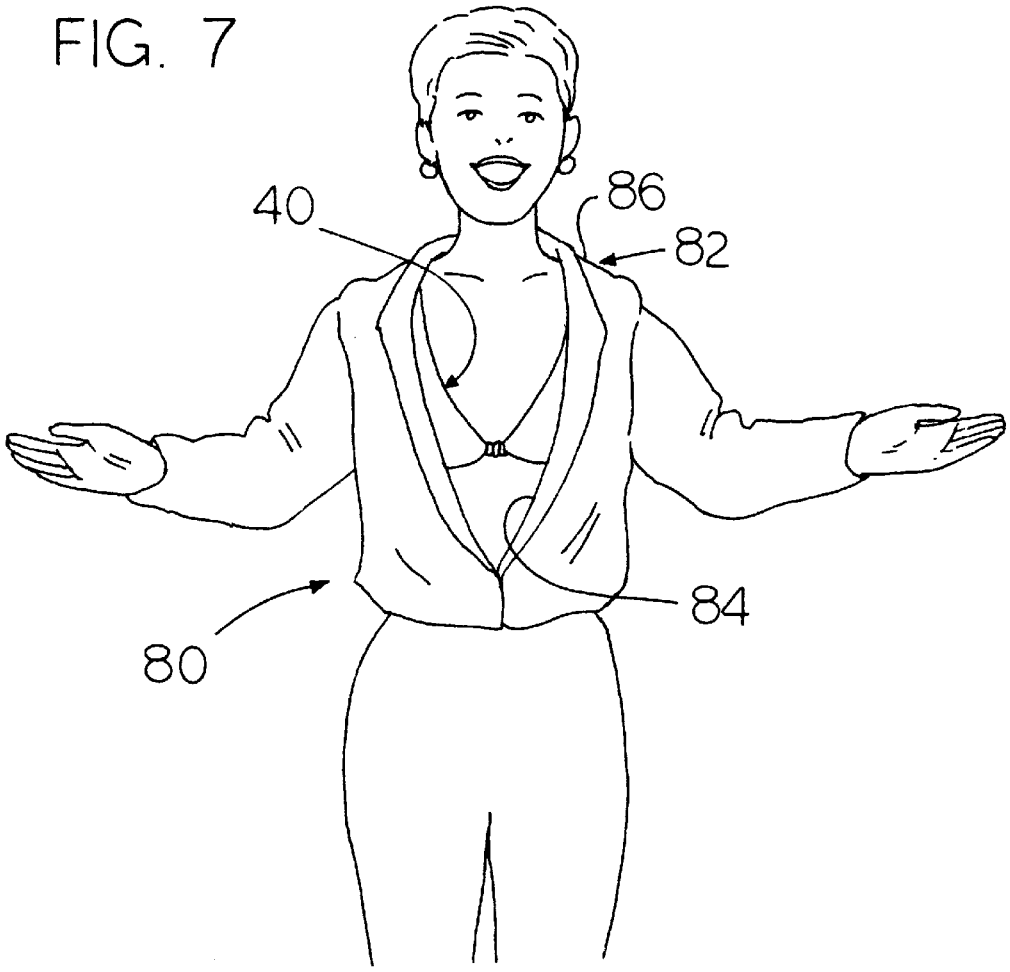
FIG. 7 is a front view similar to FIG. 1, but showing an alternate embodiment garment in accordance with the present invention.

It will be apparent that a garment in accordance with the present invention may include an outer garment of other forms. By way of non-limiting example, the outer garment may be a robe with a zippered front opening, or a sweat-suit or other casual top having a front opening and closure means. An alternate embodiment of a garment 80 having an outer garment 82 in the form of a top having a zippered front opening 84 is shown in FIG. 7. In keeping with the invention, the garment 80 includes a built-in bra 40 constructed as previously described, each of the bra shoulder straps being attached to the inside of each of the outer garment shoulders such as generally designated at 86 for the left shoulder in FIG. 7.

From the foregoing, it will be apparent that the present invention brings to the art a new and improved upper body garment with a built-in bra adapted for ease of use and for the user's comfort by providing shelf-type support for the user's breasts. To use, the outer garment and the bra are put on as a single apparel item, the front of the bra is closed, and then the robe is closed to conceal the bra. Thus, a garment according to the invention provides for breast support in a comfortable, easy-to-use arrangement without being binding or restrictive, and that is especially suitable for use with casual, leisure and nighttime wear.

I claim:

1. A women's garment comprising:

a front-opening upper-body outer garment having:
left and right front panels,
left and right shoulders connected to respective ones of said front panels, and
a first rear-portion neckline defined between said shoulders; and an independently front-opening inner bra having:
left and right breast-supporting front panels,
left and right shoulder straps connected to respective ones of (i) said left and right breast-supporting front panels and (ii) said left and right outer garment shoulders,
said breast-supporting front panels including (i) body portions of draping material extending downwardly from said shoulder straps for draping over a women's breasts, said body portions having lower portions for positioning under the breasts, and (ii) elastic means for drawing the lower body portions upwardly into supporting engagement with the lower portions of the breasts when the bra is closed; and
a second rear-portion neckline defined between said shoulder straps;

said first and second rear-portion necklines being unconnected and moveable independently of one another.

2. A women's garment comprising:

a front-opening upper-body outer garment having:
left and right front panels,
left and right shoulders connected to respective ones of said front panels, and
a first back panel connected between said shoulders; and an independently front-opening inner bra having:
left and right shoulder straps connected to the inside of said left and right shoulders, respectively,
a second back panel connected between said shoulder straps, and
left and right breast-supporting front panels including (i) body portions of draping material extending downwardly from said shoulder straps for draping over a women's breasts, said body portions having lower portions for positioning under the breasts, and (ii) elastic means for drawing the lower body portions upwardly into supporting engagement with the lower portions of the breasts when the bra is closed;

said first and second back panels being unconnected and moveable independently of one another.

3. A garment as defined in claim 2 in which said body portions are made from draping elastic material and comprise said elastic means.

4. A garment as defined in claim 2 in which said body portions include lower perimeter portions positionable under the breasts and inner perimeter portions positionable between the breasts, and in which at least one of said lower and said inner perimeter portions include said elastic means for drawing said lower body portions upwardly into said supporting engagement.

5. A women's garment comprising:

a front-opening upper-body outer garment having:
left and right front panels, and
left and right shoulders connected to respective ones of said front panels; and a front-opening inner bra having:
left and right shoulder straps connected to the inside of said left and right shoulders, respectively, left and right breast-supporting front panels, and cooperative connecting means on each of said inner bra front panels for opening and closing the bra independently of said outer garment front panels, said inner bra front panels including (i) body portions of draping material extending downwardly from said shoulder straps and having lower portions for positioning under a women's breasts, and (ii) lower elastic perimeters extending inwardly and upwardly from under the breasts to said connecting means for drawing said lower body portions upwardly into supporting engagement with the lower portions of the breasts when the bra is closed;

said body portions including inner elastic perimeters extending upwardly from said connecting means and positionable between the breasts for assisting said lower elastic perimeters in drawing the lower body portions upwardly into said supporting engagement.

6. A garment as defined in claim 5 in which said body portions are made from draping elastic material and include said lower elastic perimeters.

7. A garment as defined in claim 1 in which said body portions are made from draping elastic material and comprise said elastic means.

8. A garment as defined in claim 1 in which said body portions include lower perimeter portions positionable under the breasts and inner perimeter portions positionable between the breasts, and in which as least one of said lower and said inner perimeter portions include said elastic means for drawing said lower body portions upwardly into said supporting engagement.

9. A women's garment comprising:

a front-opening upper-body outer garment having:

left and right front panels, left and right shoulders connected to respective ones of said front panels, and a first back panel connected between said shoulders; and a front-opening inner bra having:

left and right shoulder straps connected to the inside of said left and right shoulders, respectively, a second back panel connected between said shoulder straps, left and right breast-supporting front panels, and cooperative connecting means on each of said inner bra front panels for opening and closing the bra independently of said outer garment front panels, said inner bra front panels including (i) body portions of draping material extending downwardly from said shoulder straps and having lower portions for positioning under a women's breasts, and (ii) lower elastic perimeters extending inwardly and upwardly from under the breasts to said connecting means for drawing said lower body portions upwardly into supporting engagement with the lower portions of the breasts when the bra is closed;

said first and second back panels being unconnected and moveable independently of one another.

10. A garment as defined in claim 9 in which said body portions are made from draping elastic material and include said lower elastic perimeters.

* * * * *